US007168903B2

(12) United States Patent
Hild

(10) Patent No.: US 7,168,903 B2
(45) Date of Patent: Jan. 30, 2007

(54) PUNCHING/BINDING MACHINE

(75) Inventor: Horst Hild, Mainhausen (DE)

(73) Assignee: 3T Supplies AG (CH)

( * ) Notice: Subject to any disclaimer, the term of this patent is extended or adjusted under 35 U.S.C. 154(b) by 454 days.

(21) Appl. No.: 10/475,781

(22) PCT Filed: May 15, 2002

(86) PCT No.: PCT/CH02/00265

§ 371 (c)(1),
(2), (4) Date: Oct. 23, 2003

(87) PCT Pub. No.: WO02/094576

PCT Pub. Date: Nov. 28, 2002

(65) Prior Publication Data

US 2004/0115031 A1 Jun. 17, 2004

(30) Foreign Application Priority Data

May 25, 2001 (CH) ..... 973/01

(51) Int. Cl.
*B42B 5/08* (2006.01)

(52) U.S. Cl. ..... 412/38; 412/9; 412/39; 412/40; 83/633; 83/687

(58) Field of Classification Search ..... 412/6, 412/9, 16, 33–34, 38–40; 83/633–634, 687, 83/691

See application file for complete search history.

(56) References Cited

U.S. PATENT DOCUMENTS 2,782,856 A * 2/1957 Staley ..... 30/363
4,509,397 A * 4/1985 Mori et al. ..... 83/453
5,007,782 A * 4/1991 Groswith, III et al. ..... 412/40
5,143,502 A * 9/1992 Kaufmann et al. ..... 412/16
5,273,387 A * 12/1993 Groswith, III et al. ..... 412/40
5,549,433 A * 8/1996 Byrne ..... 412/39
5,683,218 A 11/1997 Mori ..... 412/40
6,994,010 B2 * 2/2006 Hild ..... 83/691

FOREIGN PATENT DOCUMENTS

DE 19526385 A1 7/1995
DE 29707224 U1 7/1997
EP 0864441 A1 3/1997

* cited by examiner

*Primary Examiner*—Monica Carter
*Assistant Examiner*—Eric A. Gates
(74) *Attorney, Agent, or Firm*—Sughrue Mion, PLLC

(57) ABSTRACT

The invention relates to a punching/binding machine comprised of a frame (1), a matrix (3), a rake (4), a comb (2), a cutting knife (5) and a control lever with which the cutting knife (5) and/or the comb (2) can be displaced relative to the matrix (3) and/or to the rake (4). A machine requiring a minimal number of production components is obtained when the control lever (15, 14) is provided with the frame (1) as one piece and when it is engaged with at least one driving element (6) which, in turn, is separately or simultaneously engaged with the cutting knife (5) and/or with the comb (2) in order to effect said displacement. Advantages with regard to cost and operation are achieved with a combined punching/binding machine of the aforementioned type that is based on a frame consisting of two interconnected V's.

6 Claims, 5 Drawing Sheets

PUNCHING/BINDING MACHINE

Figure 1:
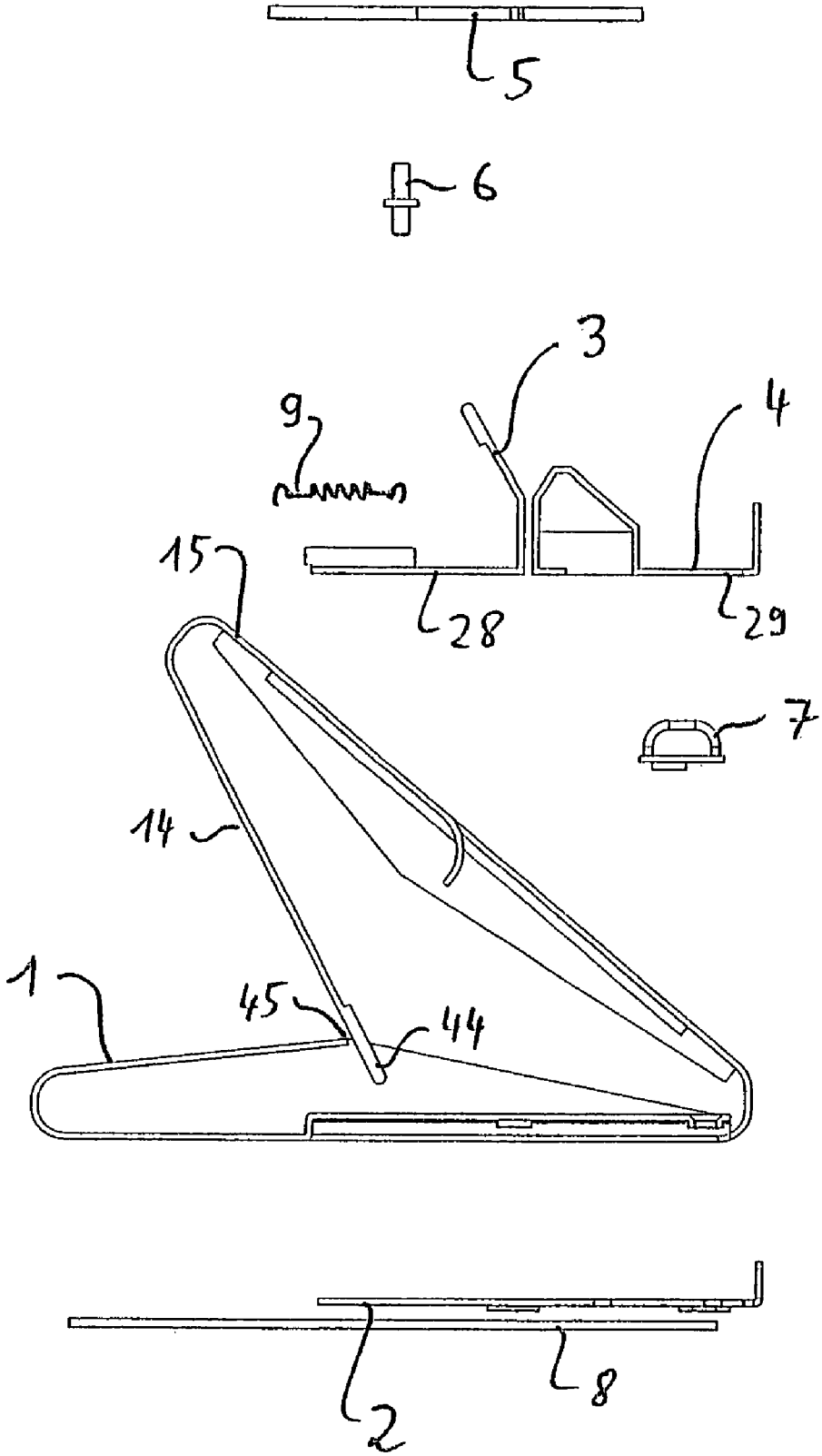

The invention relates to a punching/binding machine having a framework, having a die, having a rake, having a comb, having a cutting blade and having an operating lever by means of which the cutting blade and/or the comb can be displaced in relation to the die and/or the rake.

A number of such punching/binding machines are known from the prior art. These integrated machines serve, on the one hand, using the punching blade, to cut regular bores into sheets which are to be bound, with the result that these sheets which are to be bound can be positioned, by way of the holes, on a binding spine which is spread open with the aid of the rake and the comb.

The known punching/binding machines are produced from a large number of individual parts, which renders the production costly and maintenance difficult.

Taking this prior art as the departure point, the object of the invention is to configure a punching/binding machine of the type mentioned in the introduction such that it comprises a very small number of parts.

This object is achieved according to the invention by the characterizing features of claim 1.

The absence of deflecting devices or mounts for realizing the actuating movement gives rise to a machine which requires a minimal number of production parts.

Using such a framework which is constructed essentially from two connected Vs, it is possible to produce a combined punching/binding machine with associated advantages in respect of cost and functioning.

In the case of an advantageous configuration, the die is integral with the rake and/or these elements can be connected to one another in a non-releasable manner.

Further advantageous embodiments are characterized in the subclaims.

Figure 2:
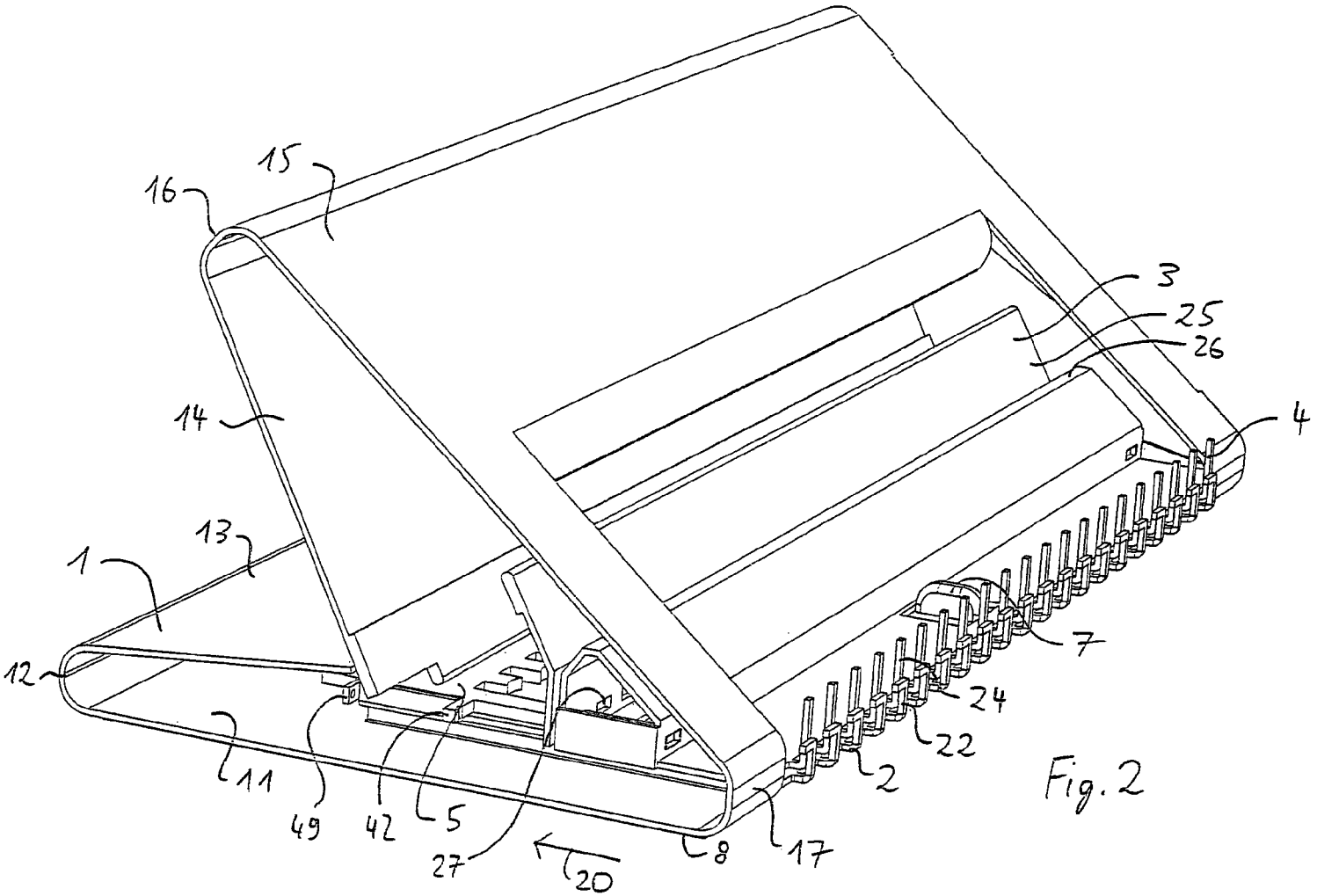
Figure 3:
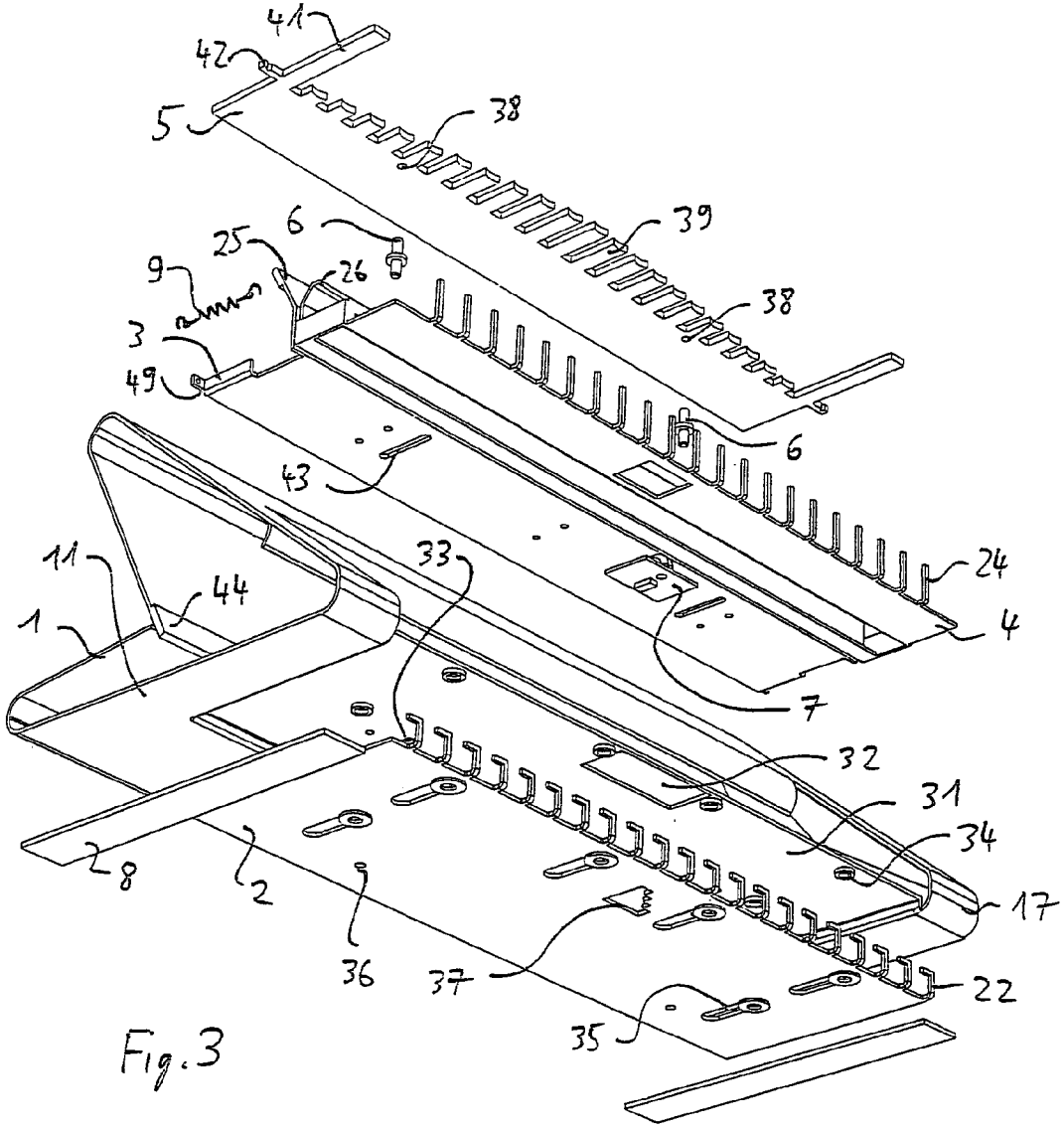
Figure 4:
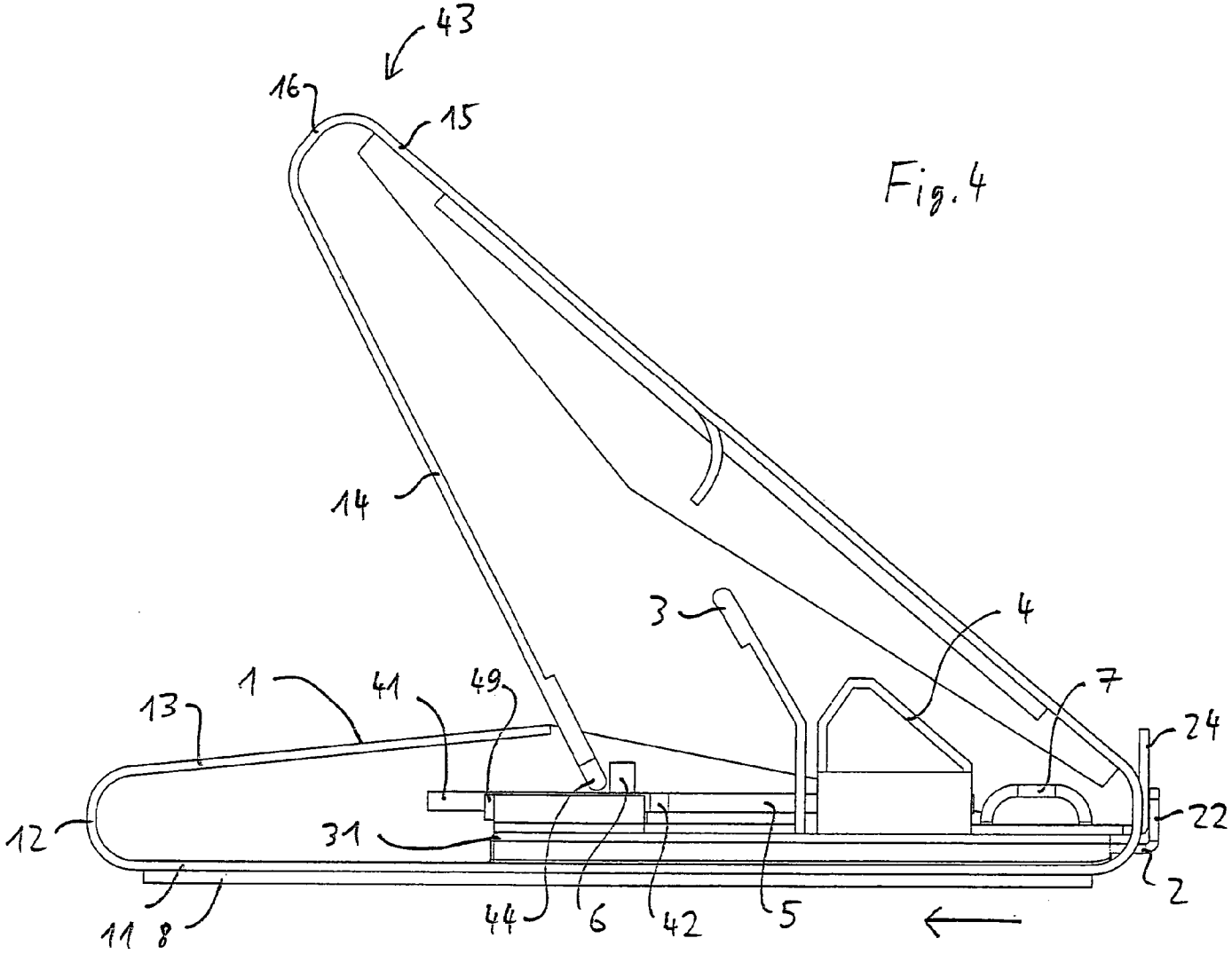
Figure 5:
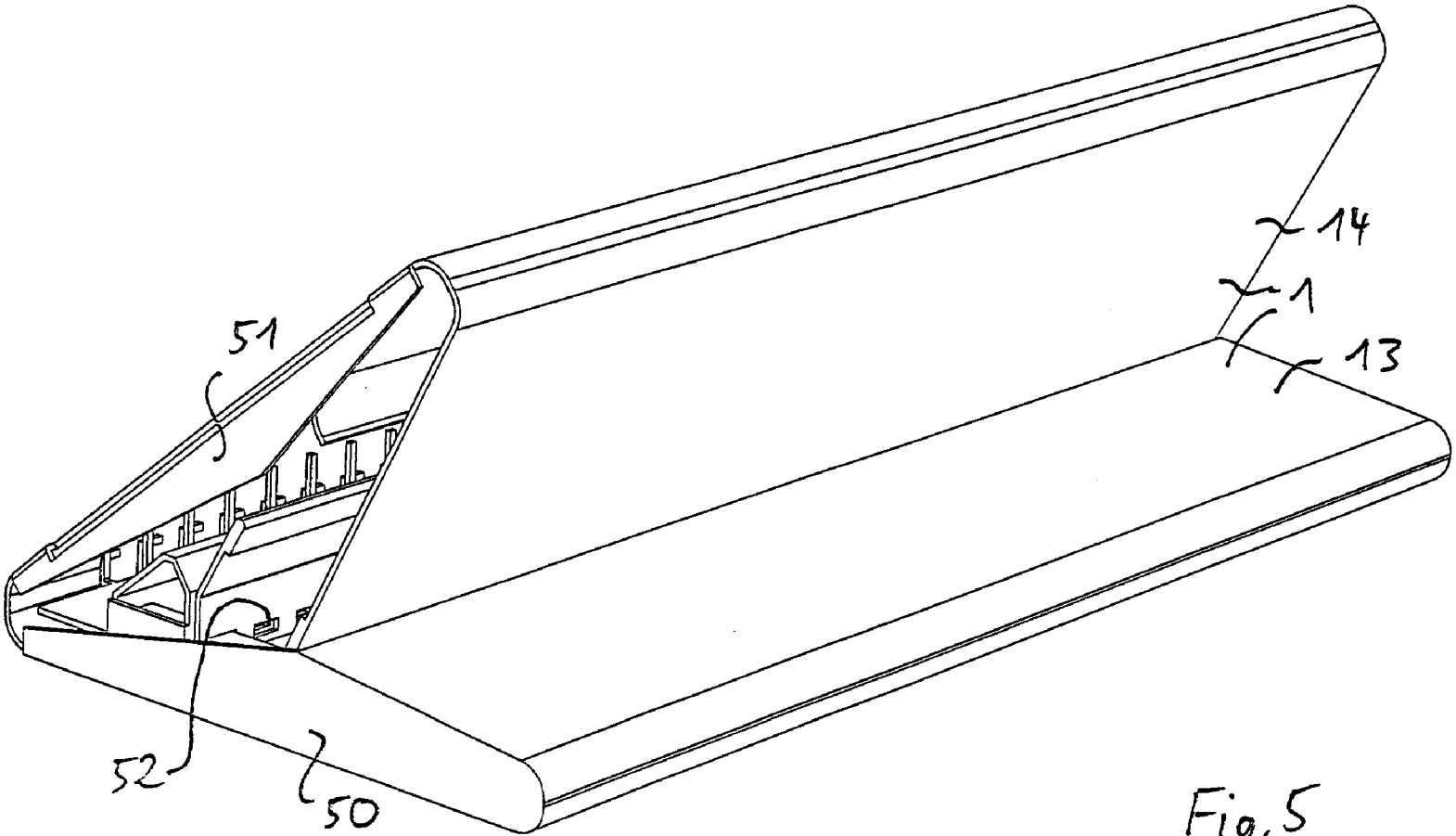

The invention will now be described in more detail herein below with reference to an exemplary embodiment which is illustrated in the drawings, in which:

FIG. 1 shows a side view of the machine according to an exemplary embodiment of the invention, the machine being illustrated in the dismantled state, FIG. 2 shows a perspective view of the assembled machine according to FIG. 1, FIG. 3 shows a perspective view from beneath of the machine according to FIG. 1, FIG. 4 shows a side view of the assembled machine according to FIG. 1, and FIG. 5 shows a perspective view of the assembled machine according to FIG. 1, the machine having been provided with a shroud.

FIG. 1 shows a side view of the machine according to an exemplary embodiment of the invention, the machine being illustrated in the dismantled state.

The combined punching and binding machine comprises five essential parts: the framework 1, which acts at the same time as operating lever with an integrated spring function; the comb 2; the die 3 and rake 4, which may be connected integrally to one another here; the cutting blade 5 and, finally, the in this case two driver pins 6. A slide 7 is advantageously also provided in order to arrest the comb 2. 8 designates underlay surfaces which are fastened, e.g. adhesively bonded, for example from beneath on lateral bottom surfaces of the framework 1. Further individual features of the abovementioned elements can be gathered from the description of the rest of the figures. Also provided is a restoring spring 9 for the driver pins 6.

FIG. 2 shows a perspective view of the assembled machine according to FIG. 1. The framework 1 advantageously comprises a single-piece metal plate which has been punched and then folded and has a non-continuous base plate 11. The latter emerges at its rear end, via a curve 12, into a housing cover surface 13, the operating lever 14, in its rest position, butting against the end 45 thereof by way of its rear side. The term operating lever 14 refers to that surface of the framework 1 which is located opposite the front side 15 and which is connected to the latter via a curve 16. The front side 15 itself is connected to the base plate 11 via a further curve 17.

The further curve 17 advantageously comprises just two lateral transitions, between which the comb 2 and rake 4 are arranged. The comb 2 is usually provided with a multiplicity of teeth 22 which, in the main axis, are located parallel to the teeth 24 of the rake 4. The teeth 22 of the comb 2 are provided with transversely extending noses in order to retain a binding spine, which is positioned between the comb 2 and the rake 4 and is opened when the rake 4 is moved in the direction of the arrow 20. The rake 4 can be arrested by displacement of the slide 7.

In the exemplary embodiment illustrated, are the die element 3 has a top stripper part 25 which, with the opposite element of the rake 4, forms an introduction slot for paper. Provided over the depth of the die 3 are bores for the lead-throughs of the blades, these being designated 27 in the rake 4.

The cutting blade 5 has a multiplicity of individual blade elements which are made in one piece, in particular punched. The cutting blade 5 rests on base surfaces 28 and 29 of the die 3 and rake 4, respectively. One or more drivers 6, which cannot be seen in FIG. 2, form elements which extend beyond the plane of the blades and against which the operating-lever part 14 of the framework 1 butts.

FIG. 3 shows a perspective view from beneath of the machine according to FIG. 1. The raised base plate 31 of the framework 1 is clearly evident, this base plate having a cutout 32 for the slide and slots 33 for the driver pins 6. Extensions 34 which are formed in the base plate 31 by punching engage in slots 35 of the comb 2, with the result that the comb 2 can be displaced in relation to the framework 1 with the aid of the driver pins 6 extending through the in bores 36. A bore 37, which has a stepped profile, is intended for engaging with the slide 7 in order to fix the comb 2 in relation to the rake 4 in a position which is determined by the user.

The slots 33 of the base surface 31 of the framework 1 have counterparts, or slots 43, in the rake 4 in order to move the cutting blade 5 in relation to the die 5, connected to the rake 4, by way of the driver pins 6, which are fixed in bores 38 in respect of the cutting blade 5, and to punch holes in the paper stacks positioned between the elements 25 and 26.

It should be noted that the cutting blade 5, as far as the tips of the individual blade elements 39 are concerned, is preferably in a form which avoids the situation where all the cutting blades simultaneously pierce the paper which is to be punched. That may be provided, in particular, by the V-shape of the blade according to FIG. 3.

FIG. 4 shows a side view of the assembled machine according to FIG. 1. Like designations are used for like features in all the figures. It can thus be seen here that the lateral extensions 41 of the cutting blade 5 serve for guidance between lateral edges of the die 3 and that the lateral continuations 42 of the cutting blade 5, together with the continuations 49 provided laterally on the die 3, serve for clamping in position the restoring springs 9, which are preferably used on both sides as tension springs, for the cutting blade 5, which is guided by the driver pins 6.

It is clear that, by virtue of pressure exerted, for example, in arrow direction 43, the bottom edge 44 of the operating lever 14, said edge resting on the cutting blade 5, is moved forward counter to the direction of the arrow 20 and, via the driver pins 6, also moves the cutting blade through the die 3. The rake 4, which is connected to the die 3, does not move here. In contrast, the pins 6, which project through the slots 43 in the die 3 and slots 33 in the base part 31, carry along the comb 2 and the teeth 22 move away from the teeth 24. It is possible for the position which the teeth 22 and 24 reach relative to one another to be fixed by the slide.

Finally, FIG. 5 shows a perspective view of the assembled machine according to FIG. 1, the machine having been provided with a shroud. The lateral regions between the underside 11 and the rear side 13 is covered in each case by screens 50. The triangular surface 51, which has been punched out of the front side 15, serves as a stop in relation to the screen 50 and the operating-lever side 14. Holes 52 in the die 3 can also be seen in FIG. 5. For reasons of clarity, the restoring spring 9 has not been illustrated. This is fitted into the bore in the continuations 49 and, furthermore, engages in the groove in the associated continuation 42. Instead of being fastened in the continuations 49, it could also be fastened on the framework 1 itself. Instead of a restoring spring 9, it would also be possible for the driver pins to be connected to the bottom edge 44 of the lever directly, e.g. by hinge strips, and thus to be moved along therewith in both movement directions.

The invention claimed is:

1. A punching/binding machine having a framework, having a die, having a rake, having a comb, having a cutting blade and having an operating lever by means of which the cutting blade and/or the comb can be displaced in relation to the die and/or the rake, wherein the operating lever is integral with the framework and engages with at least one driver element which, for the said displacement movement, engages with the cutting blade and/or the comb individually or at the same time;

wherein the framework comprises a base element which is adjoined, on the front side, by a bow-spring element which forms an acute angle and is adjoined by a first arm of an essentially V-shaped operating lever which, in the depth of the V, merges, via a further bow-spring element, into the second arm of the operating lever, the free end thereof engaging with the at least one driver element; and wherein the bow-spring elements are pre-bent, and wherein the second arm of the operating lever is prestressed under prestressing against the free end of a housing cover surface, which extends in an essentially parallel or slightly inclined manner in relation to the base element and projects from the latter by way of a curved element.

2. A punching/binding machine having a framework, having a die, having a rake, having a comb, having a cutting blade and having an operating lever by means of which the cutting blade and/or the comb can be displaced in relation to the die and/or the rake, wherein the operating lever is integral with the framework and engages with at least one driver element which, for the said displacement movement, engages with the cutting blade and/or the comb individually or at the same time; and wherein the at least one driver element is a pin which passes through a locating bore in the cutting blade and through a locating bore in the comb, whereas it passes through the framework and/or die in each case in slots.

3. A punching/binding machine, comprising: a framework, having a base element; an essentially V-shaped operating lever having a first arm and a second arm, the first arm being integral with the base element and forming, on a front side, a resilient connection with the framework with an acute angle, and the second arm being integral with the first arm, connected in the depth of the V via a further resilient connection to the first arm with an acute angle, said framework and said lever being formed from one continuous piece of a folded metal plate; a die; a rake; a comb; a cutting blade; and at least one driver element; wherein the operating lever is adapted to displace the cutting blade and/or the comb in relation to the die and/or the rake; and wherein a free end of the second arm of the operating lever engages with the at least one driver element which, for the said displacement movement, engages with the cutting blade and/or the comb individually or at the same time.

4. The punching/binding machine as claimed in claim 3, wherein in the framework the base element is raised in its central part, and the comb is fastened in a displaceable manner beneath the base element plate.

5. The punching/binding machine as claimed in claim 3, wherein the die and rake are of integral design or are connected to one another in a non-releasable manner.

6. The punching/binding machine as claimed in claim 3 wherein at least one restoring spring is provided, and this is fastened, on the one hand, in the framework or on a continuation of the die and, on the other hand, on the cutting blade.

* * * * *